US005655388A

United States Patent [19]

Bonaquist et al.

[11] Patent Number: 5,655,388

[45] Date of Patent: Aug. 12, 1997

[54] CRYOGENIC RECTIFICATION SYSTEM FOR PRODUCING HIGH PRESSURE GASEOUS OXYGEN AND LIQUID PRODUCT

[75] Inventors: Dante Patrick Bonaquist, Grand Island; Robert Arthur Beddome; Michael Yijian Jin, both of Tonawanda, all of N.Y.

[73] Assignee: Praxair Technology, Inc., Danbury, Conn.

[21] Appl. No.: 507,959

[22] Filed: Jul. 27, 1995

[51] Int. Cl.[6] ..... F25J 3/00

[52] U.S. Cl. ..... 62/651; 62/654

[58] Field of Search ..... 62/39, 41, 24

[56] References Cited

U.S. PATENT DOCUMENTS

| | | | |
|---|---|---|---|
| 3,754,406 | 8/1973 | Allam | 62/41 |
| 4,279,631 | 7/1981 | Skolaude | 62/29 |
| 4,345,925 | 8/1982 | Cheung | 62/13 |
| 4,372,764 | 2/1983 | Theobald | 62/13 |
| 4,705,548 | 11/1987 | Agrawal et al. | 62/22 |
| 4,778,497 | 10/1988 | Hanson et al. | 62/11 |
| 5,222,365 | 6/1993 | Nenov | 62/39 |
| 5,231,835 | 8/1993 | Beddome et al. | 62/9 |
| 5,271,231 | 12/1993 | Ha et al. | 62/39 |
| 5,329,776 | 7/1994 | Grenier | 62/24 |
| 5,337,571 | 8/1994 | Ducrocq et al. | 62/39 |
| 5,386,692 | 2/1995 | LaForce | 62/41 |
| 5,402,647 | 4/1995 | Bonaquist et al. | 62/39 |
| 5,428,962 | 7/1995 | Rieth | 62/41 |

OTHER PUBLICATIONS

Springman, H., The Production Of High-Pressure Oxygen, Linde Reports On Science and Technology, 1980.

*Primary Examiner*—Ronald C. Capossela
*Attorney, Agent, or Firm*—Stanley Ktorides

[57] ABSTRACT

A cryogenic rectification system wherein liquid oxygen from a cryogenic air separation plant is pressurized and then vaporized in a high pressure liquefier producing product high pressure oxygen gas and generating liquid nitrogen for enhanced liquid product production.

10 Claims, 3 Drawing Sheets

CRYOGENIC RECTIFICATION SYSTEM FOR PRODUCING HIGH PRESSURE GASEOUS OXYGEN AND LIQUID PRODUCT

TECHNICAL FIELD

This invention relates generally to cryogenic air separation and more particularly to cryogenic air separation wherein pressurized liquid oxygen is vaporized.

BACKGROUND ART

Oxygen is produced commercially in large quantities by the cryogenic rectification of feed air, generally employing the well known double column system, wherein product oxygen is taken from the lower pressure column. At times it may be desirable to produce oxygen at a pressure which exceeds its pressure when taken from the lower pressure column. In such instances, gaseous oxygen may be compressed to the desired pressure. However, it is generally preferable for capital cost purposes to remove oxygen as liquid from the lower pressure column, pump it to a higher pressure, and then vaporize the pressurized liquid oxygen to produce the desired elevated pressure product oxygen gas.

Cryogenic rectification requires refrigeration in order to operate. The requisite refrigeration is increased when oxygen is withdrawn from the column as liquid and pumped prior to vaporization because the pump work is added to the system. Refrigeration may be provided to the cryogenic process by the turboexpansion of a stream fed into the rectification column system. However, the compression of a stream for the turboexpansion consumes a significant amount of energy.

The problem is more acute when liquid product is also desired because the recovery of product as liquid removes a significant amount of refrigeration from the air separation plant.

Accordingly, it is an object of this invention to provide a cryogenic rectification system which can produce elevated pressure gaseous oxygen by the vaporization of pressurized liquid oxygen withdrawn from the cryogenic rectification plant while also enabling improved production of liquid product.

SUMMARY OF THE INVENTION

The above and other objects which will become apparent to those skilled in the art upon a reading of this disclosure are attained by the present invention, one aspect of which is:

A method for producing elevated pressure gaseous oxygen and liquid nitrogen comprising:

(A) passing feed air into a cryogenic air separation plant and producing gaseous nitrogen and liquid oxygen within the cryogenic air separation plant;

(B) withdrawing gaseous nitrogen from the cryogenic air separation plant, increasing the pressure of the withdrawn gaseous nitrogen, passing a first portion of the resulting elevated pressure gaseous nitrogen through a high pressure heat exchanger, and passing a second portion of the resulting elevated pressure gaseous nitrogen through only a portion of the high pressure heat exchanger;

(C) withdrawing liquid oxygen from the cryogenic air separation plant, increasing the pressure of the withdrawn liquid oxygen, and vaporizing the resulting elevated pressure liquid oxygen by indirect heat exchange with elevated pressure gaseous nitrogen within the high pressure heat exchanger to produce elevated pressure gaseous oxygen and liquid nitrogen; and (D) expanding the second portion of the elevated pressure gaseous nitrogen to generate refrigeration and warming the expanded second portion by passage through the high pressure heat exchanger.

Another aspect of the invention is:

Apparatus for producing elevated pressure gaseous oxygen and liquid nitrogen comprising:

(A) a cryogenic air separation plant and means for passing feed air into the cryogenic air separation plant;

(B) a compressor, a high pressure heat exchanger, and means for passing gaseous nitrogen from the cryogenic air separation plant to the compressor and from the compressor to the high pressure heat exchanger;

(C) a liquid pump, means for passing liquid oxygen from the cryogenic air separation plant to the liquid pump and from the liquid pump to the high pressure heat exchanger, and means for recovering elevated pressure gaseous oxygen from the high pressure heat exchanger; and (D) an expander, means for passing gaseous nitrogen from within the high pressure heat exchanger to the expander and from the expander to the high pressure heat exchanger.

As used herein, the term "feed air" means a mixture comprising primarily nitrogen, oxygen and argon, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed and which may include a heat exchanger or a top condenser in its upper portion.

As used herein the term "cryogenic air separation plant" means the columns wherein feed air is separated by cryogenic rectification, as well as interconnecting piping, valves, heat exchangers and the like.

As used herein the terms "liquid oxygen" and "gaseous oxygen" means respectively a liquid and a gas having an oxygen concentration equal to or greater than 50 mole percent.

As used herein the terms "liquid nitrogen" and "gaseous nitrogen" mean respectively a liquid and a gas having a nitrogen concentration equal to or greater than 80 mole percent.

DETAILED DESCRIPTION

The present invention is a system which combines the warming of liquid oxygen, which has been withdrawn from a cryogenic air separation plant and pumped to an elevated pressure, with the liquefaction of nitrogen to simultaneously produce elevated pressure gaseous oxygen and sufficient liquid nitrogen to permit the net production of liquid nitrogen, liquid oxygen or both. Thus, gaseous oxygen is produced at an elevated pressure without the use of an oxygen compressor. The energy needed to elevate the pressure of the oxygen stream is derived in part from a liquid pump and from the compression of nitrogen to an elevated pressure and its subsequent condensation against the warming oxygen. A portion of the compressed nitrogen is expanded to an intermediate pressure to produce sufficient refrigeration to return liquid nitrogen to the cryogenic air separation plant sufficient to compensate for the withdrawal of liquid oxygen and to accommodate the net production of liquid product.

Figure 1:
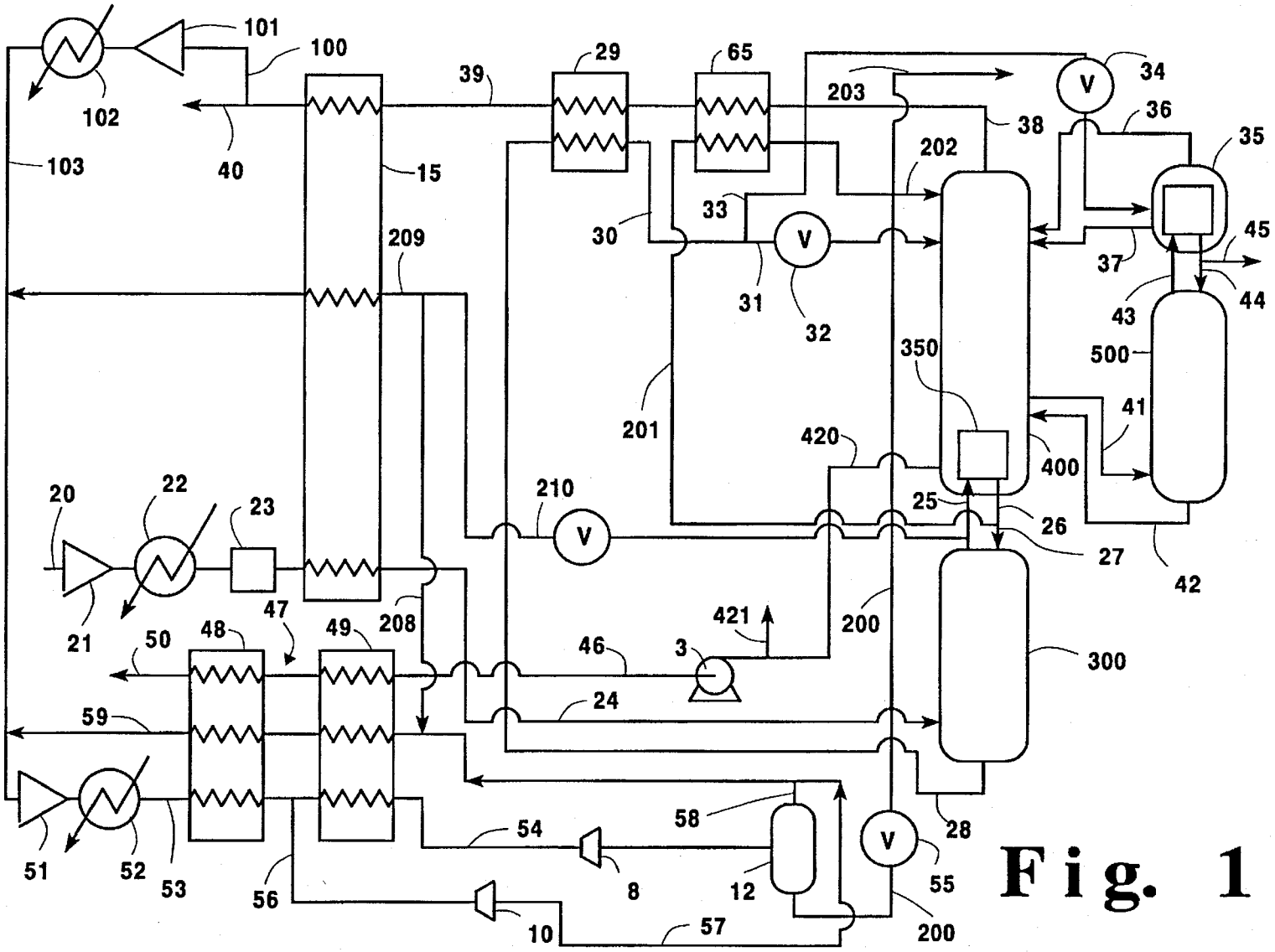
FIG. 1 is a schematic representation of one preferred embodiment of the invention wherein liquid nitrogen produced in the high pressure heat exchanger is recovered.

The invention will be described in greater detail with reference to the Drawings. Referring now to FIG. 1, feed air 20 is compressed in compressor 21, cooled in cooler 22 and cleaned of high boiling impurities such as water vapor and carbon dioxide in purifier 23. The cleaned feed air is then cooled by passage through primary heat exchanger 15 against return streams and then passed as stream 24 into column 300 which is the higher pressure column of a double column system of a cryogenic air separation plant which also includes lower pressure column 400 and, in the embodiment illustrated in FIG. 1, argon column 500.

Column 300 generally is operating at a pressure within the range of from 50 to 150 pounds per square inch absolute (psia). Within column 300, the feed air is separated by cryogenic rectification into nitrogen-enriched top vapor and oxygen-enriched bottom liquid. As mentioned, the cryogenic rectification plant illustrated in FIG. 1 also includes a third column which in this case is an argon column for the production of crude argon. Nitrogen-enriched top vapor is passed from column 300 into main condenser 350 wherein it is condensed against reboiling column 400 bottoms. Resulting liquid nitrogen 26 is passed in stream 27 as reflux into column 300, and in stream 201 through heat exchanger 65 into column 400 as reflux stream 202. Oxygen-enriched liquid is passed in stream 28 from column 300 through heat exchanger 29, wherein it is subcooled by indirect heat exchange with a return stream, and resulting stream 30 is divided into first part 31, which is passed through valve 32 and into column 400, and into second part 33 which is passed through valve 34 into top condenser 35 of argon column 500. In top condenser 35, the oxygen-enriched liquid is partially vaporized and the resulting vapor and remaining liquid are passed into column 400 in streams 36 and 37 respectively.

Column 400 is operating at a pressure less than that of column 300 and generally within the range of from 10 to 60 psia. Within column 400 the fluids fed into column 400 are separated by cryogenic rectification into nitrogen-rich vapor and oxygen-rich liquid, i.e. liquid oxygen. Nitrogen-rich vapor or gaseous nitrogen is withdrawn from column 400 in line 38, warmed by passage through heat exchangers 65 and 29 and then passed as stream 39 through primary heat exchanger 15. If desired, some of this nitrogen may be recovered as product gaseous nitrogen 40.

An argon containing fluid is passed from column 400 to argon column 500 in line 41, and is separated by cryogenic rectification in argon column 500 into argon-richer vapor and oxygen-richer liquid. The oxygen-richer liquid is returned to column 500 by line 42. Argon-richer vapor is passed in line 43 into top condenser 35 wherein it is partially condensed by indirect heat exchange with the oxygen-enriched fluid. Resulting argon-richer fluid is passed in stream 44 into column 500 as reflux and a portion 45 is recovered as product crude argon having an argon concentration of at least 90 mole percent.

Liquid oxygen is withdrawn from column 400 in line 420 and pumped to a higher pressure by passage through liquid pump 3 generally to a pressure within the range of from 25 to 1000 psia. The resulting pressurized liquid oxygen stream 46 is then passed through high pressure heat exchanger 47, which in this embodiment comprises two heat exchanger modules 48 and 49, wherein it is vaporized by indirect heat exchange with elevated pressure gaseous nitrogen as will be later more fully described. Resulting elevated pressure gaseous oxygen 50 is recovered as product oxygen gas. If desired, some liquid oxygen may also be recovered as indicated by line 421.

At least a portion of gaseous nitrogen stream 39 is passed as stream 100 to compressor 101 wherein it is compressed to a pressure within the range of from 25 to 250 psia. The resulting stream is cooled through cooler 102 to form pressurized gaseous nitrogen stream 103.

The pressurized gaseous nitrogen 103 is further pressurized to a pressure within the range of from 100 to 1500 psia by passage through compressor 51 and cooled in cooler 52 to remove heat of compression. The resulting pressurized gaseous nitrogen 53 is then passed through high pressure heat exchanger 47 wherein it is at least partially condensed by indirect heat exchange with vaporizing liquid oxygen 46 and recycle gaseous nitrogen. A first portion 54 of the pressurized gaseous nitrogen passes entirely through heat exchanger 47 while a second portion 56 is withdrawn after only partial traverse of heat exchanger 47. Resulting nitrogen first portion stream 54 is expanded, such as by passage through expander 8, to a pressure within the range of from 15 to 250 psia and passed into phase separator 12. Liquid nitrogen is passed out from phase separator 12 as stream 200 and passed through valve 55. A portion of liquid nitrogen stream 200 may be returned to the cryogenic air separation plant such as is shown in FIG. 1 by combination with reflux stream 202. A portion of liquid nitrogen stream 200 may be recovered as liquid nitrogen product such as is shown in FIG. 1 by stream 203.

Second portion stream 56 is withdrawn from the high pressure heat exchanger 47 after traverse of module 48 and then turboexpanded through turboexpander 10 to generate refrigeration. Resulting stream 57, which may be combined with gaseous nitrogen 58 from phase separator 12, is warmed by passage through high pressure heat exchanger 47 to balance the heat exchanger for more efficient liquefaction of the pressurized gaseous nitrogen. Resulting warmed stream 59 is combined with stream 103 for reuse.

The conventional step of warming the product stream in the main heat exchanger against incoming feed air is not practiced with this invention. Rather, some nitrogen-enriched vapor is taken from stream 25 in stream 210 so as to properly balance main heat exchanger 15. This is done by using the combination of streams 210 and 208 to obtain stream 209 such that the ratio of the flow for stream 24 to the sum of the flows for streams 39 and 209 is about 1.0. Stream 209 is passed into stream 103 and stream 208 is passed into stream 57 as shown.

Figure 2:
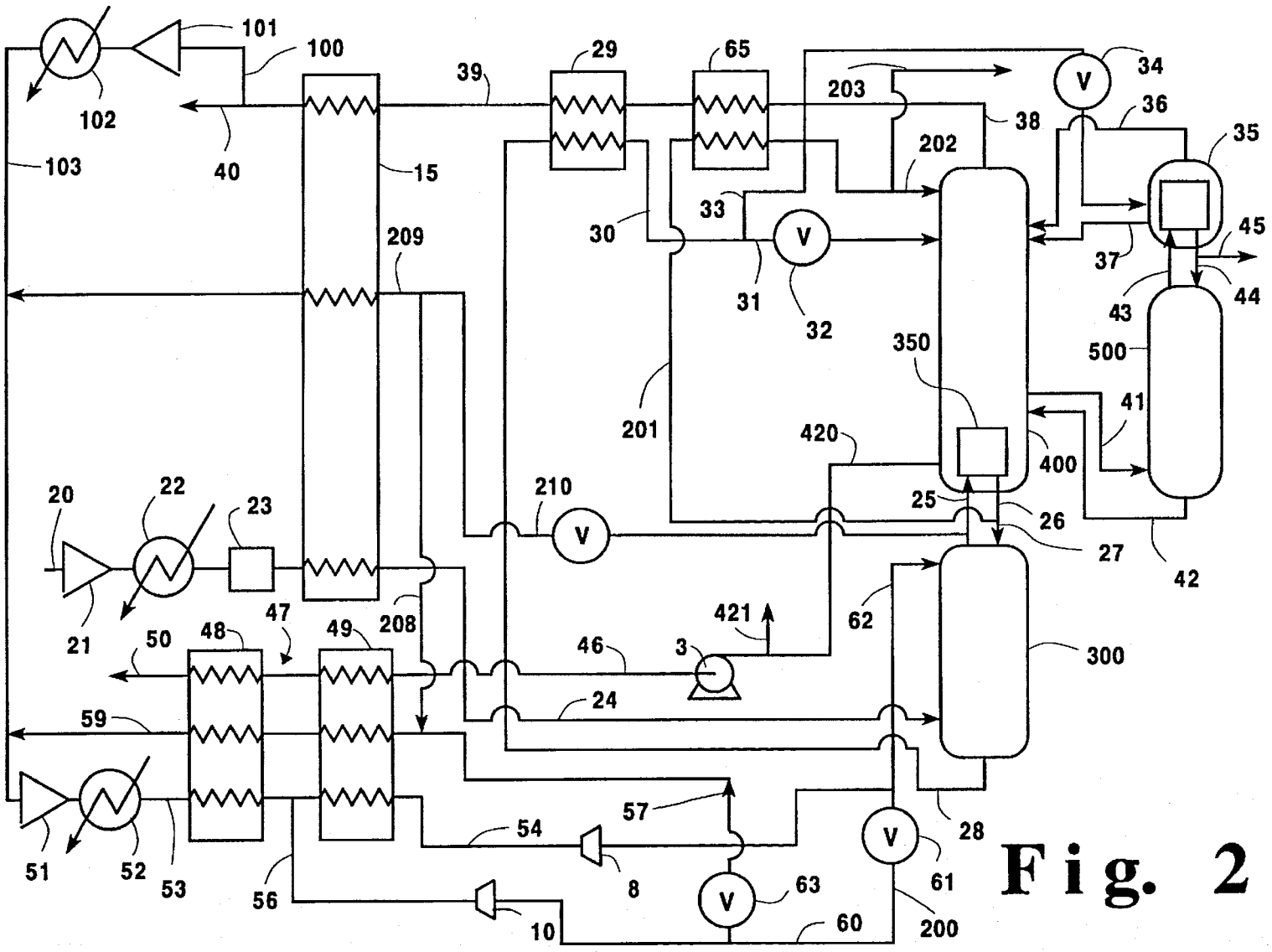
FIG. 2 is a schematic representation of another preferred embodiment of the invention wherein liquid nitrogen produced in the high pressure heat exchanger is returned to the cryogenic air separation plant.

FIG. 2 illustrates another embodiment of the invention wherein liquid nitrogen produced in the high pressure heat exchanger is passed into the higher pressure column. The numerals of FIG. 2 are the same as those of FIG. 1 for the common elements and these common elements will not be described again in detail. Referring now to FIG. 2, a portion 60 of stream 57 is passed through valve 61 and combined with the entire stream 54 exiting expander 8. Resulting combined stream 62 is then passed into higher pressure column 300 as reflux. Liquid nitrogen may be recovered directly from the cryogenic air separation plant such as is shown by stream 63 taken from stream 202. The remainder of stream 57 is passed through valve 63 and recycled through high pressure heat exchanger 47 to balance the heat exchanger for the nitrogen liquefaction as in the embodiment illustrated in FIG. 1.

Figure 3:
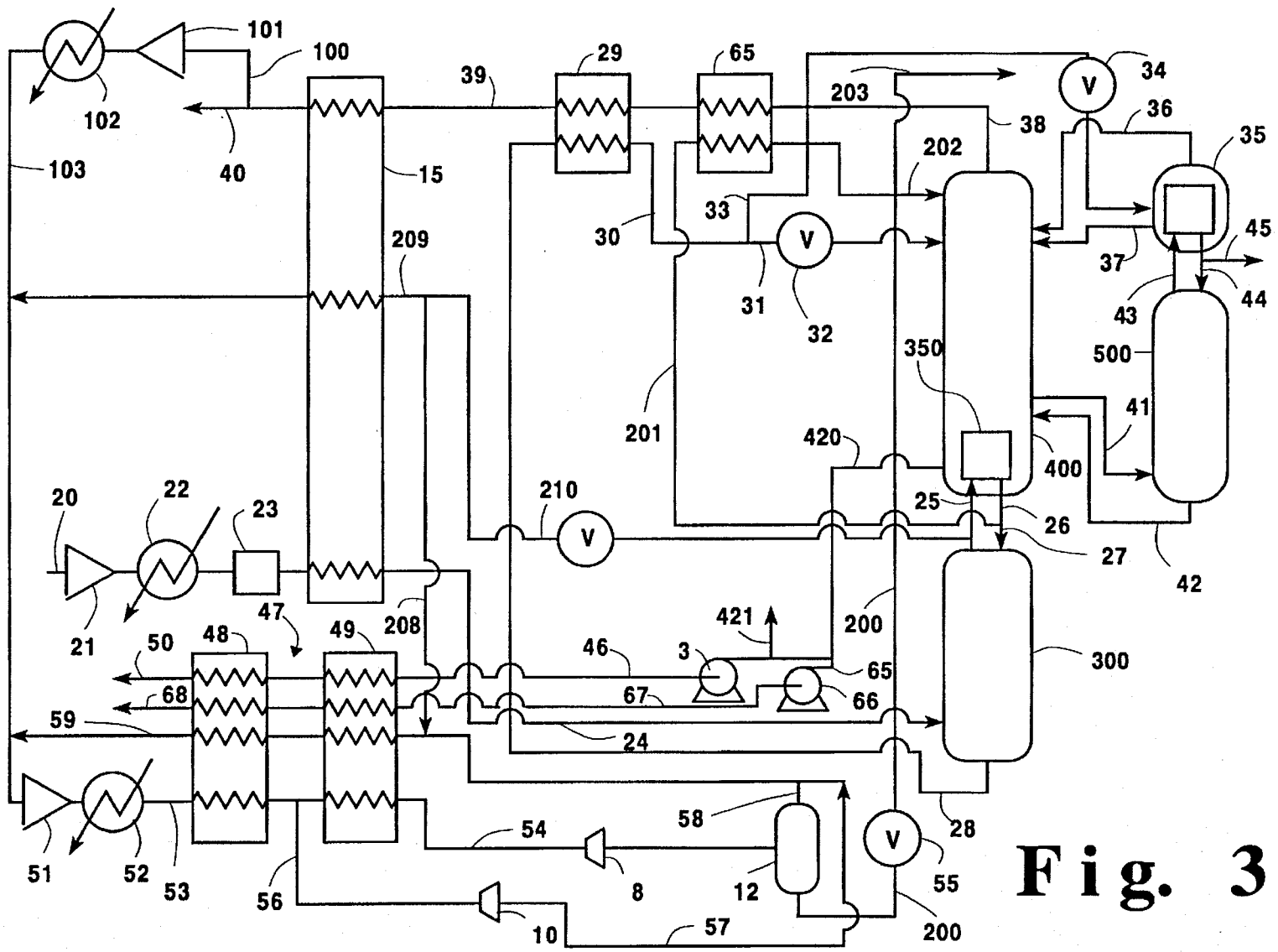
FIG. 3 is a schematic representation of another preferred embodiment of the invention wherein gaseous oxygen is produced at two separate pressure levels.

If desired the gaseous oxygen product of the invention may be produced at two separate pressures. For example, a portion of liquid oxygen stream 420 may be routed around liquid pump 3, or a portion of the pressurized liquid oxygen stream 46 exiting pump 3 may be expanded, prior to passing the resulting liquid oxygen streams through heat exchanger 47. FIG. 3 illustrates another embodiment of such dual pressure gaseous product system. The numerals of FIG. 3 are the same as those of FIG. 1 for the common elements and these common elements will not be described again in detail. Referring now to FIG. 3, a portion 65 of stream 420 is not passed through pump 3 but, rather, is passed through pump 66 wherein it is pumped to a pressure different from that of stream 46. Such resulting stream 67 is passed through heat exchanger 47 along with stream 46 producing gaseous oxygen products 68 and 50 respectively at two different pressures.

The invention enables one to produce elevated pressure gaseous oxygen without need for a gaseous oxygen compressor while simultaneously efficiently producing liquid product, e.g. liquid nitrogen and/or liquid oxygen. Although the invention has been described in detail with reference to certain preferred embodiments, those skilled in the art will recognize that there are other embodiments of the invention within the spirit and the scope of the claims.

What is claimed is:

1. A method for producing elevated pressure gaseous oxygen and liquid nitrogen comprising:

(A) passing feed air into a cryogenic air separation plant and producing gaseous nitrogen and liquid oxygen within the cryogenic air separation plant;

(B) withdrawing gaseous nitrogen from the cryogenic air separation plant, increasing the pressure of the withdrawn gaseous nitrogen, passing a first portion of the resulting elevated pressure gaseous nitrogen through a high pressure heat exchanger, and passing a second portion of the resulting elevated pressure gaseous nitrogen through only a portion of the high pressure heat exchanger;

(C) withdrawing liquid oxygen from the cryogenic air separation plant, increasing the pressure of the withdrawn liquid oxygen, and vaporizing the resulting elevated pressure liquid oxygen by indirect heat exchange with elevated pressure gaseous nitrogen within the high pressure heat exchanger to produce elevated pressure gaseous oxygen and liquid nitrogen; and (D) expanding the second portion of the elevated pressure gaseous nitrogen to generate refrigeration and warming the expanded second portion by passage through the high pressure heat exchanger.

2. The method of claim 1 further comprising recovering some liquid oxygen as liquid product.

3. The method of claim 1 further comprising recovering some liquid nitrogen as liquid product.

4. The method of claim 1 wherein the cryogenic air separation plant comprises a double column having a higher pressure column and a lower pressure column and wherein liquid nitrogen from the high pressure heat exchanger is passed into the lower pressure column.

5. The method of claim 1 wherein the cryogenic air separation plant comprises a double column having a higher pressure column and a lower pressure column and wherein liquid nitrogen from the high pressure heat exchanger is passed into the higher pressure column.

6. The method of claim 1 wherein liquid oxygen is vaporized by indirect heat exchange with elevated pressure gaseous nitrogen at two pressure levels thereby producing gaseous oxygen at two pressure levels.

7. Apparatus for producing elevated pressure gaseous oxygen and liquid nitrogen comprising:

(A) a cryogenic air separation plant and means for passing feed air into the cryogenic air separation plant;

(B) a compressor, a high pressure heat exchanger, and means for passing gaseous nitrogen from the cryogenic air separation plant to the compressor and from the compressor to the high pressure heat exchanger;

(C) a liquid pump, means for passing liquid oxygen from the cryogenic air separation plant to the liquid pump and from the liquid pump to the high pressure heat exchanger, and means for recovering elevated pressure gaseous oxygen from the high pressure heat exchanger; and (D) an expander, means for passing gaseous nitrogen from within the high pressure heat exchanger to the expander and from the expander to the high pressure heat exchanger.

8. The apparatus of claim 7 wherein the cryogenic air separation plant comprises a double column having a higher pressure column and a lower pressure column, further comprising means for passing liquid from the high pressure heat exchanger to the lower pressure column.

9. The apparatus of claim 7 wherein the cryogenic air separation plant comprises a double column having a higher pressure column and a lower pressure column, further comprising means for passing liquid from the high pressure heat exchanger to the higher pressure column.

10. The apparatus of claim 7 further comprising a second liquid pump, means for passing liquid from the cryogenic air separation plant to the second liquid pump and from the second liquid pump to the high pressure heat exchanger, and second means for recovering elevated pressure gaseous oxygen from the high pressure heat exchanger.

* * * * *